US008033964B1

(12) United States Patent
Chen

(10) Patent No.: US 8,033,964 B1
(45) Date of Patent: Oct. 11, 2011

(54) DUMBBELL ASSEMBLY

(76) Inventor: Chin-Long Chen, Taichung County (TW)

( * ) Notice: Subject to any disclaimer, the term of this patent is extended or adjusted under 35 U.S.C. 154(b) by 0 days.

(21) Appl. No.: 12/796,268

(22) Filed: Jun. 8, 2010

(51) Int. Cl.
*A63B 21/00* (2006.01)

(52) U.S. Cl. ..... 482/106; 482/107

(58) Field of Classification Search ..... 482/104–108
See application file for complete search history.

(56) References Cited

U.S. PATENT DOCUMENTS

| | | | | |
|---|---|---|---|---|
| 4,252,316 | A * | 2/1981 | Price | 482/106 |
| 6,022,300 | A * | 2/2000 | Hightower | 482/106 |
| 6,663,542 | B1 * | 12/2003 | Trabbic | 482/106 |
| 7,056,268 | B2 * | 6/2006 | Emick | 482/106 |
| 2010/0160124 | A1 * | 6/2010 | Berenshteyn | 482/106 |

* cited by examiner

*Primary Examiner* — Jerome W Donnelly

(57) ABSTRACT

A dumbbell assembly includes a tube, a rod rotatably received in the tube, and two rotary units respectively connected to two ends of the rod. Each rotary unit has a wing to which multiple weight members are connected. The rod is rotated relative to the tube and the wings together with the weight members are rotated to generate centrifugal forces which apply to the user's muscles.

7 Claims, 5 Drawing Sheets

DUMBBELL ASSEMBLY

FIELD OF THE INVENTION

The present invention relates to a dumbbell assembly, and more particularly, to a dumbbell with rotatable weight members on two ends thereof.

BACKGROUND OF THE INVENTION

A conventional dumbbell assembly 50 is shown in FIG. 5 and generally includes a rod 51 and multiple disk-like weight members 52 connected to two ends of the rod 51. The rod 51 includes two threaded ends 511 and the weight members 52 are mounted to the two threaded ends 511 and two nuts are respectively and threadedly connected to the threaded ends 511 to fix the weight members 52.

Although the number of the weight members can be adjusted, the dumbbell assembly can only be used to lift it up and down, which is so boring and the users easily give up.

The present invention intends to provide a dumbbell assembly which includes two wings rotatably connected to the rod and each wing is optionally connected to at least one weight members. The rod is rotatably received in a tube so that when using the dumbbell assembly, the wings rotate to apply centrifugal forces to the user's muscles.

SUMMARY OF THE INVENTION

The present invention relates to a dumbbell assembly which comprises a tube, a rod rotatably received in the tube, and two rotary units respectively connected to two ends of the rod. Each rotary unit has a wing and multiple weight members are connected to the wings of the rotary units.

The primary object of the present invention is to provide a dumbbell assembly wherein the rod is rotated relative to the tube and the wings together with the weight members are rotated to generate centrifugal forces which exercise the user's muscles.

Another object of the present invention is to provide a dumbbell assembly wherein the weight members can be adjusted their positions on the wings so as to adjust the centrifugal forces that exercise the user's muscles.

Yet another object of the present invention is to provide a dumbbell assembly wherein the wings have support ends which support the dumbbell assembly on the ground or the rack.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
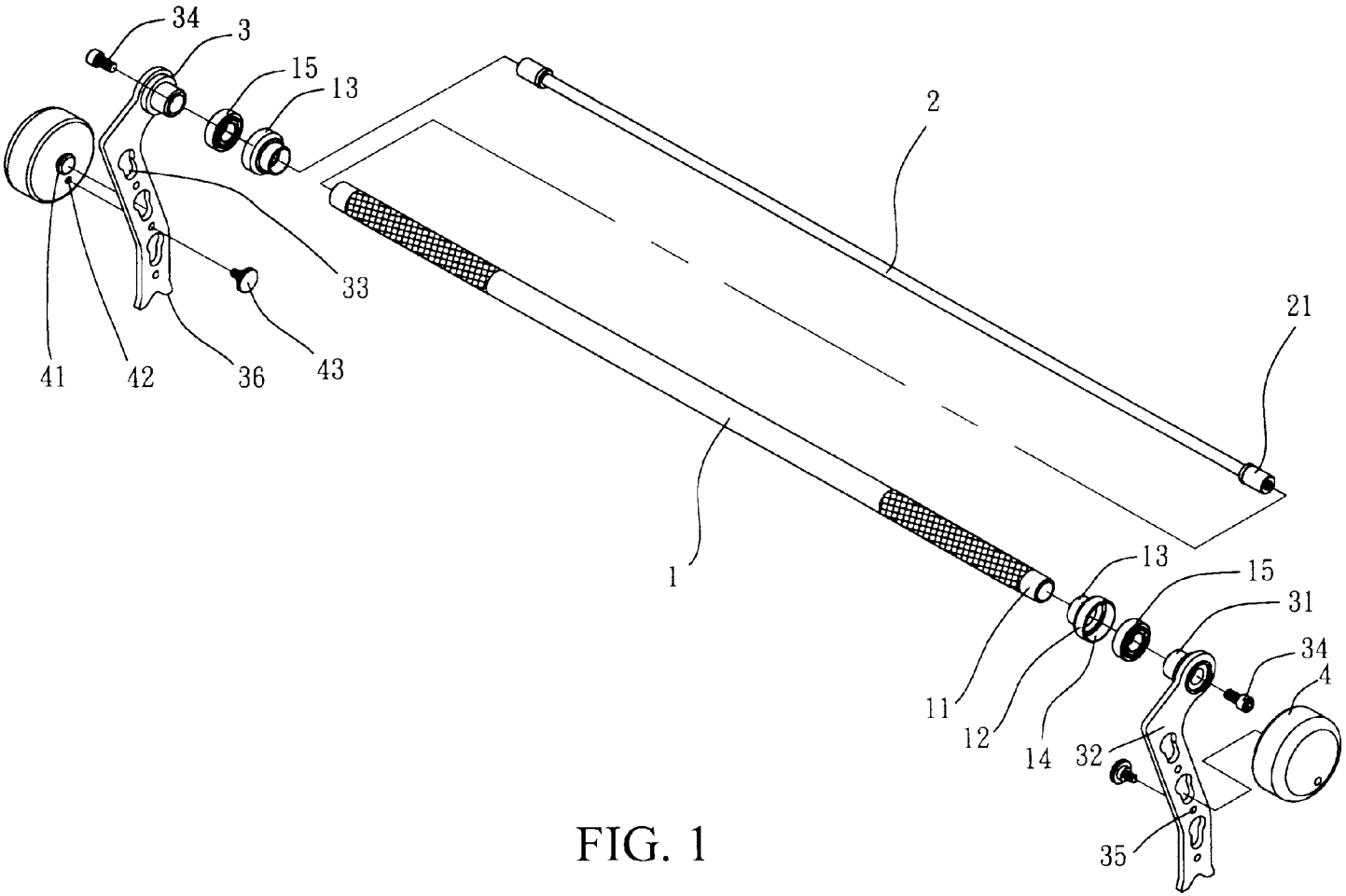
FIG. 1 is an exploded view to show the dumbbell assembly of the present invention.
Figure 2:
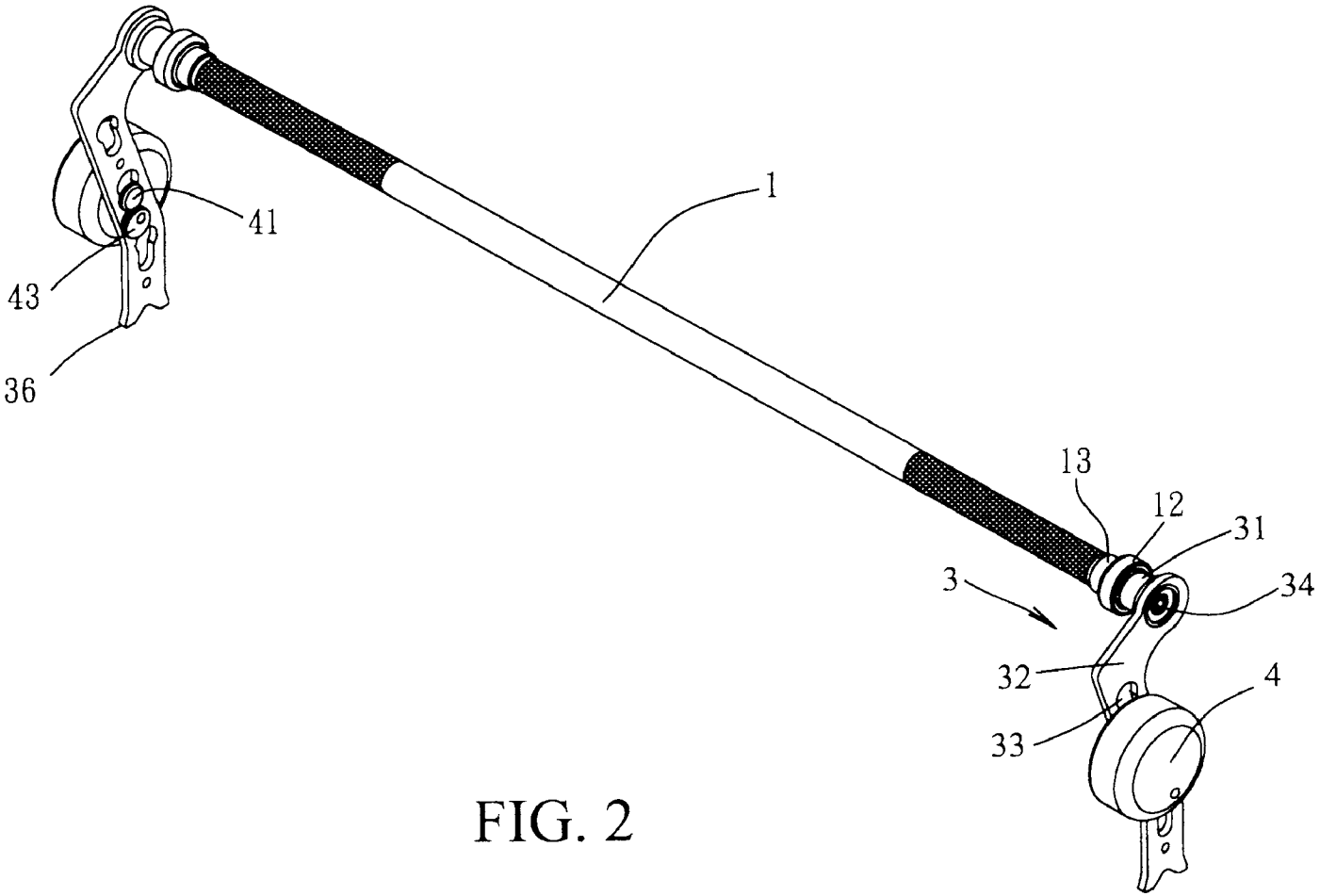
FIG. 2 is a perspective view to show the dumbbell assembly of the present invention.
Figure 3:
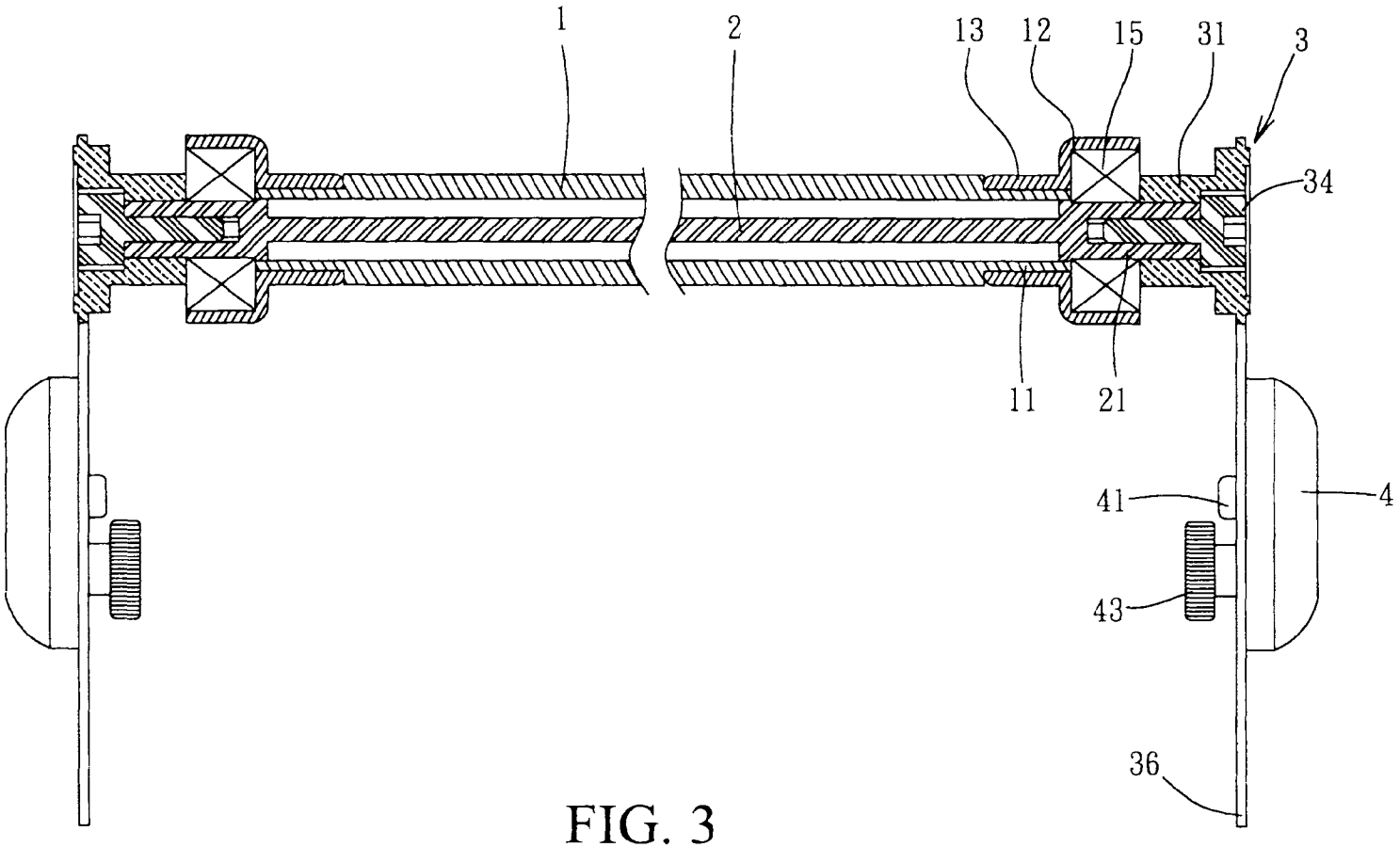
FIG. 3 is a cross sectional view of the dumbbell assembly of the present invention.

Referring to FIGS. 1 to 3, the dumbbell assembly of the present invention comprises a tube 1 including two connection ends 11 on two ends thereof, two reception members 12 and two bearings 15. The two reception members 12 are respectively connected to the two connection ends 11 of the tube 1. Each reception member 12 includes a tubular portion 13 on a first side thereof and a space 14 in a second side thereof. The connection ends 11 of the tube 1 are connected to the two tubular portions 13. The two bearings 15 are received in the two spaces 14.

A rod 2 is rotatably received in the tube 1 and includes two pivotal ends 21 on the two ends thereof. The pivotal ends 21 extend through the connection ends 11 and the bearings 15 are connected to the pivotal ends 21.

Two rotary units 3 are respectively connected to two ends of the rod 2 and each rotary unit 3 has a wing 32. Each of the rotary unit 3 comprises a protrusion 31 which is in contact with a side of the rotary unit 3 so that the pivotal end 21 of the rod 2 is connected to the protrusion 31. Each of the rotary units 3 has a fixing member 34 which extends through the wing 32 of the rotary unit 3 and is fixedly connected to the pivotal end 21 of the rod 2. The wing 32 of each of the rotary units 3 includes at least one aperture 33 and a hole 35 is located below the at least one aperture 33. Each wing 32 includes a support end 36 at a distal end thereof so that the dumbbell assembly can be put on the floor or supported on the rack by the support ends 36 of the two wings 32. It is understood that the number of the wing 32 and the aperture 33 can be multiple when needed.

Multiple weight members 4 connected to the wings 32 of the rotary units 3 and each of the weight members 4 has an engaging protrusion 41. The weight member 4 is connected to the at least one aperture 33 of the rotary unit 3 by extending the engaging protrusion 41 through the at least one aperture 33. A positioning member 43 extends through hole 35 of the rotary unit 3 and is fixedly connected to the locking hole 42 of the weight member 4 to connect the weight member 4 to the wing 32.

When using the dumbbell assembly, the user holds the tube 1 and rotated his/her arms so that the rod 2 is rotated relative to the tube 1, and the wings 32 together with the weight members 4 are rotated. The rotation of the wings 32 and the weight members 4 generate centrifugal forces to the user's arms and the centrifugal forces exercise the user's muscles. The dumbbell assembly can also be used to lift up and down as the conventional dumbbell assembly. The weight members 4 can be connected to different apertures 33 of the wings 32 and the number of the weight members 4 can be changed according the user's need.

Figure 4:
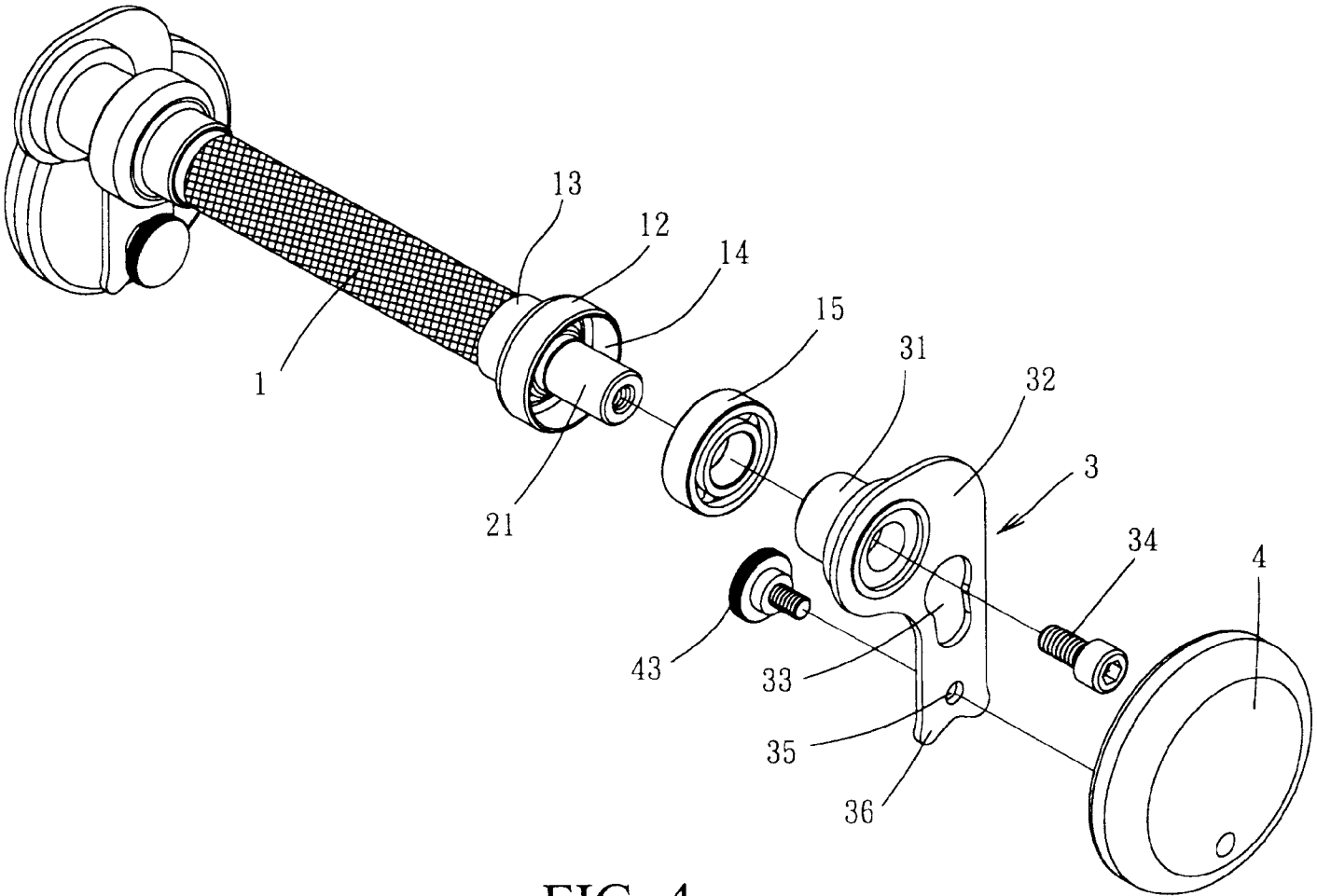
FIG. 4 is an exploded view to show another embodiment of the dumbbell assembly of the present invention.
Figure 5:
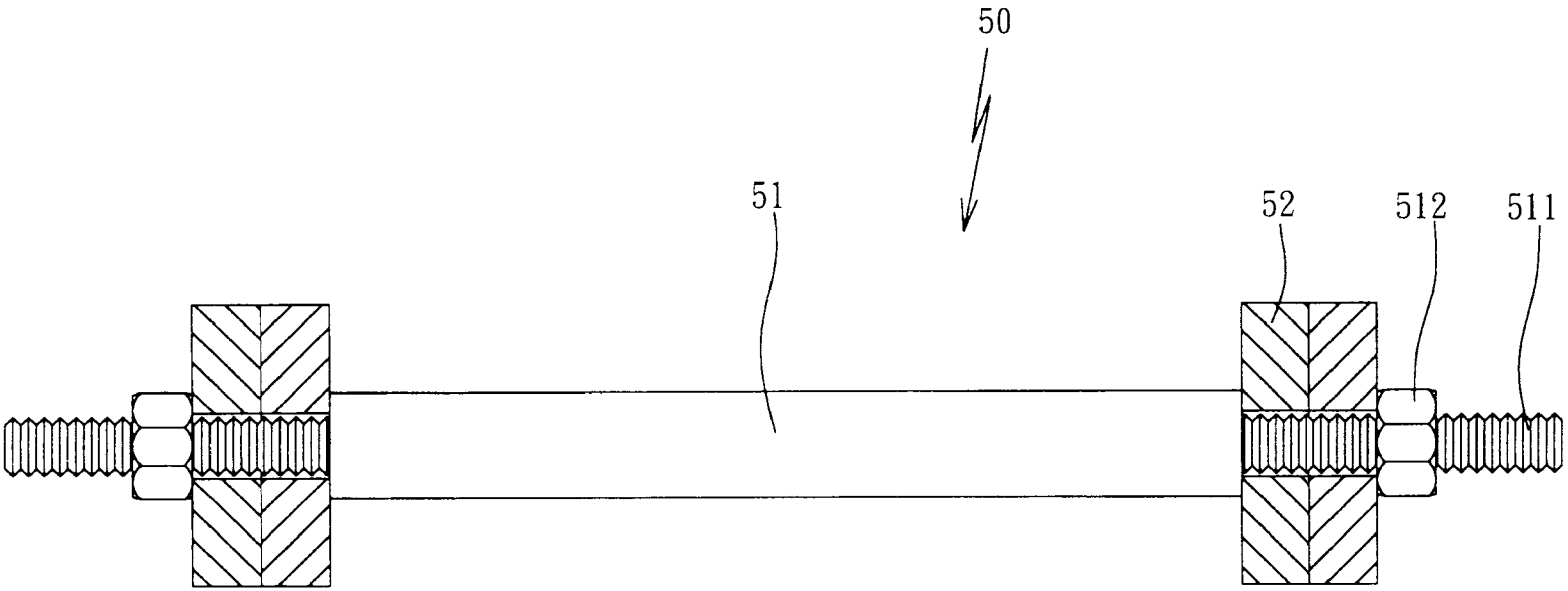
FIG. 5 PRIOR ART
FIG. 5 is a cross sectional view of the conventional dumbbell assembly.

FIG. 4 shows another embodiment of the present invention, wherein each wing 32 of the rotary unit 3 has only one aperture 33 and only one hole 35, and only one weight member 4 is connected to the wing 32. The tube 1 and rod 2 are shorter compared to the first embodiment, so that the user can operate the dumbbell assembly by one hand and operate as the conventional dumbbell.

While we have shown and described the embodiment in accordance with the present invention, it should be clear to those skilled in the art that further embodiments may be made without departing from the scope of the present invention.

What is claimed is:

1. A dumbbell assembly comprising:

a tube including a connection end on each of two ends thereof;

a rod rotatably received in the tube and a pivotal end connected to each of two ends of the rod;

each of the two connection ends of the tube having a reception member connected thereto, each reception member including a tubular portion on a first side thereof and a space defined in a second side thereof;

two rotary units respectively connected to two ends of the rod and each rotary unit having a wing, and multiple weight members connected to the wings of the rotary units.

2. The assembly as claimed in claim 1, wherein two bearings are mounted to the two pivotal ends of the rod and received in the two respective spaces of the two reception members.

3. The assembly as claimed in claim 2, wherein each of the rotary units comprises a protrusion which is in contact with a side of the rotary unit so that the pivotal end of the rod is connected to the protrusion.

4. The assembly as claimed in claim 3, wherein the wing of each of the rotary units includes at least one aperture.

5. The assembly as claimed in claim 4, wherein each of the weight members has an engaging protrusion which is connected to the at least one aperture of the rotary unit.

6. The assembly as claimed in claim 5, wherein each of the rotary units has a fixing member which extends through the rotary unit and is fixedly connected to the pivotal end of the rod.

7. The assembly as claimed in claim 6, wherein each of the weight members has a positioning member which extends through the wing of the rotary unit and the weight member.

* * * * *